US006555069B1

(12) United States Patent
Ferguson

(10) Patent No.: US 6,555,069 B1
(45) Date of Patent: Apr. 29, 2003

(54) OIL LAMP WITH CERAMIC DIFFUSER

(75) Inventor: John A. Ferguson, Westerville, OH (US)

(73) Assignee: Bath & Body Works, Inc., Reynoldsburg, OH (US)

( * ) Notice: Subject to any disclaimer, the term of this patent is extended or adjusted under 35 U.S.C. 154(b) by 0 days.

(21) Appl. No.: 09/579,033

(22) Filed: May 26, 2000

(51) Int. Cl.[7] ..... A62B 7/08

(52) U.S. Cl. ..... 422/126; 239/44; 422/4; 422/5; 422/120; 422/125; 431/320

(58) Field of Search ..... 422/125, 126, 422/1, 4, 5, 120; 431/320; 239/44

(56) References Cited

U.S. PATENT DOCUMENTS 651,100 A * 6/1900 Blakely ..... 422/126
3,355,913 A * 12/1967 Frangos ..... 126/350.1
4,477,414 A * 10/1984 Muramoto et al. ..... 122/366
5,840,246 A * 11/1998 Hammons et al. ..... 239/54
5,840,257 A * 11/1998 Bureau et al. ..... 422/125

* cited by examiner

*Primary Examiner*—Krisanne Thornton
(74) *Attorney, Agent, or Firm*—Colucci & Umans; Peter C. Michalos; Angelo Notaro

(57) ABSTRACT

An oil lamp emitting a fragrance has a container including a fuel oil and a fragrance and a wick for drawing fuel oil out of the container for burning. A separate ceramic diffuser is positioned adjacent the top of the lamp, near the combustion end of the wick. The ceramic diffuser receives a combination of fuel oil and fragrance and diffuses the fragrance into the air. The diffusion is increased when the lamp is lighted. The lamp provides a scent to the surrounding air which is similar in strength to fragranced wax candles.

19 Claims, 4 Drawing Sheets

OIL LAMP WITH CERAMIC DIFFUSER

FIELD AND BACKGROUND OF THE INVENTION

The present invention relates generally to the field of oil lamps and in particular to a new and useful oil lamp having a porous diffuser for imparting a fragrance into the air from the oil lamp.

Many different types of oil-burning lamps are known. Some lamps incorporate a fragrance into the fuel oil, while others provide for a separate fragrant emitting portion, or emanator.

U.S. Pat. No. 5,840,246, for example, is for an oil lamp having a porous emanator supported on the neck of a container holding a flammable liquid, such as oil. A wick holder passes through the center of the emanator and supports a wick therein. The wick is in contact with the oil and draws oil up above the emanator for combustion. The emanator is impregnated with a fragrance, which is released into the air, especially when the wick is lit.

The wick holder in U.S. Pat. No. 5,840,246 is not used to draw oil and fragrance from the flammable liquid up to the emanator; the holder is an optional component for supporting the wick.

The oil lamp claimed by U.S. Pat. No. 4,892,711 has a canister holding the fuel oil, a burner assembly supported on the canister, and a fragrance element spaced from the burner assembly. In a preferred embodiment, the fragrance dispensing element is "ring-like" and it is "mounted on said canister and surrounding said burner assembly". Only the fragrance element contains a fragrance in the oil lamp of U.S. Pat. No. 4,892,711, and the element does not contact the wick.

A leak-proof lamp is shown in U.S. Pat. No. 5,000,678 which has an inner flange having substantially the same frusto-conical shape as the outer covering that is fit over the opening of the fuel oil container. The inner flange extends into the opening of the container and seals against the inner wall of the container opening. The outer covering has a bottom edge which is secured around a horizontal lip on the container opening. The inner flange is secured to the outer covering by spot welding, or they can be formed integral.

Other lamps include U.S. Pat. No. 5,891,400 for a heat-activated volatile substance dispenser. The dispenser has two containers, an inner container holding a heat source, such as a candle and an outer container surrounding the inner container forming an annulus holding a gel incorporating the volatile substance. The inner container has an open top and holds a burnable material, such as a candle. The combustion of the candle in the inner container causes the gel in the annulus to release fragrance when heated by the walls of the inner container.

Other patents disclose oil lamps having drip collars around the neck, such as U.S. Pat. No. 40,094. The body of the lamp vessel is generally cylindrical with rounded sides and a neck opening at the top. An annular depression is formed around the neck opening to catch dripping oil and prevent it from falling outside the lamp body. There is no fragrance emitting portion on this lamp.

A fuel supply vessel for an oil burning incubator lamp has a centrally located raised neck for supporting the lamp and holding the wick in position to deliver fuel to the lamp from the vessel is taught by U.S. Pat. No. 871,016. The fuel supply vessel has a raised outer edge as well, to form a reservoir pan around the raised neck on top of the vessel. The reservoir is filled with water to dissipate heat from the burning lamp wick.

U.S. Pat. No. 3,790,332 shows a oil lamp candle having a wick holder which floats on the fuel oil in a container, such as a glass. The wick holder is a cylindrical boat with a raised central portion supporting the wick above the outer edge of the boat, and forming an annular space inside the boat. The annular space is not disclosed as being filled by any substance and is left open.

U.S. Pat. No. 3,958,917 teaches a scented ring for use with candles made of a wax-like material impregnated with a fragrant composition. The ring is positioned around the wick of a wax candle and is consumed by use, while releasing fragrance.

An oil lamp for diffusing fragrance contained in the oil is disclosed in U.S. Pat. No. 5,669,767. The lamp has a metal tube wick holder supported by a perforated cone in the neck of the lamp vessel. The burning wick heats the tube, which in turn heats the oil, causing it to release fragrance into the air through the perforations in the cone.

A primary difficulty experienced by many prior art oil lamps which emit a fragrance is to provide a sufficient amount of fragrance from the lamp. This problem is apparent especially when the fragrance is combined in the oil being burned. The intent of these lamps is that the oil and fragrance will both drawn up the wick and fragrance will be released. However, typically, both the fuel oil and fragrance oil are burned, generating either only a "fuel" smell, or a burnt smell from combustion of the fragrance.

Lamps which have separate fragrance emanators suffer from the difficulty of ensuring the fragrance is released at a sufficiently high rate so that the fragrance is smelled over the burning of the fuel oil. It is common to use the heat of the flame burning fuel oil to warm a separate emanator, usually by placing them in proximity to each other, to enhance the release rate of fragrance from the emanator.

SUMMARY OF THE INVENTION

It is an object of the present invention to provide an oil lamp which emits a strong fragrance, especially when lighted.

It is a further objection of the invention to provide an oil lamp which includes protection from spills and leaks.

Yet another object of the invention is to provide an oil lamp having a diffuser for fragrance oil combined with the fuel oil.

Accordingly, an oil lamp is provided having a container with a top opening, a ceramic diffuser mounted in the top opening, a sealing gasket between the top opening and ceramic diffuser, a wick holder covering the ceramic diffuser and secured to the top opening, and a wick passing through the ceramic diffuser and one end extending above the wick holder. The other end of the wick extends into a mixture of fuel oil and fragrance in the container. Fragrance and fuel oil are both drawn up the wick. Some oil is absorbed by the ceramic diffuser and diffused into the air surrounding the oil lamp. Other fuel oil and fragrance are burned at the top end of the wick above the wick holder.

The oil lamp contains a mixture of fuel oil and about 3–5% wt. of perfume. The intensity of the perfume is sufficient to mask the smell of burning fuel oil and perfume and provides a scent which is at least as intense as perfumed wax candles.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
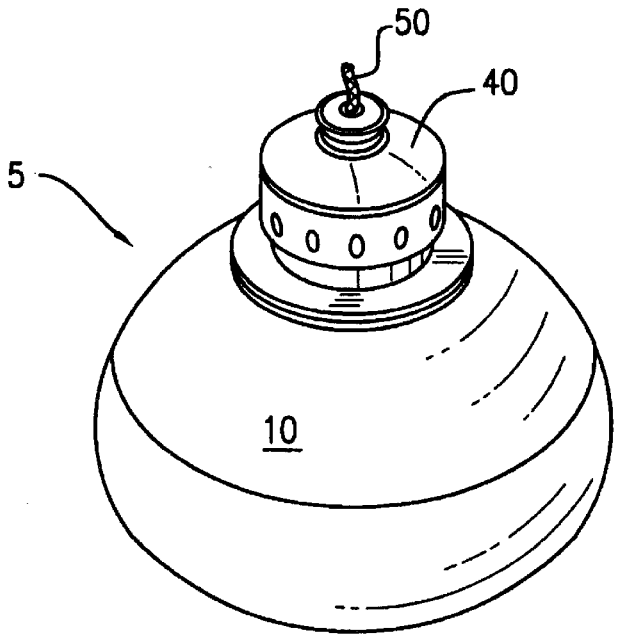
FIG. 1 is a top, front, side perspective view of an oil lamp according to the invention.

Referring now to the drawings, in which like reference numerals are used to refer to the same or similar elements, FIG. 1 shows an oil lamp 5 having a container 10 for holding fuel oil and a perfume, an outer cover 40 and a fiber wick 50. The outer cover 40 protects the fragrance diffusing portion of the lamp 5 and helps to seal the top opening of the container 10. The container 10 can be any known shape which provides a decorative look and will stand substantially upright so that a flame on wick 50 can burn without disruption. A container shape having a reduced cross-sectional area at the bottom is preferred so that less fuel is wasted due to lack of access to the wick 50.

Figure 2:
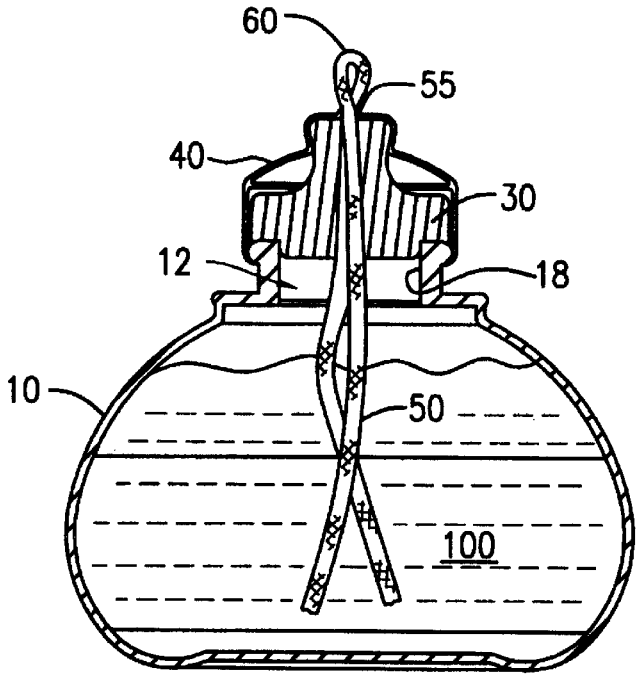
FIG. 2 is a is a sectional side elevational view of the oil lamp of FIG. 1.
Figure 3:
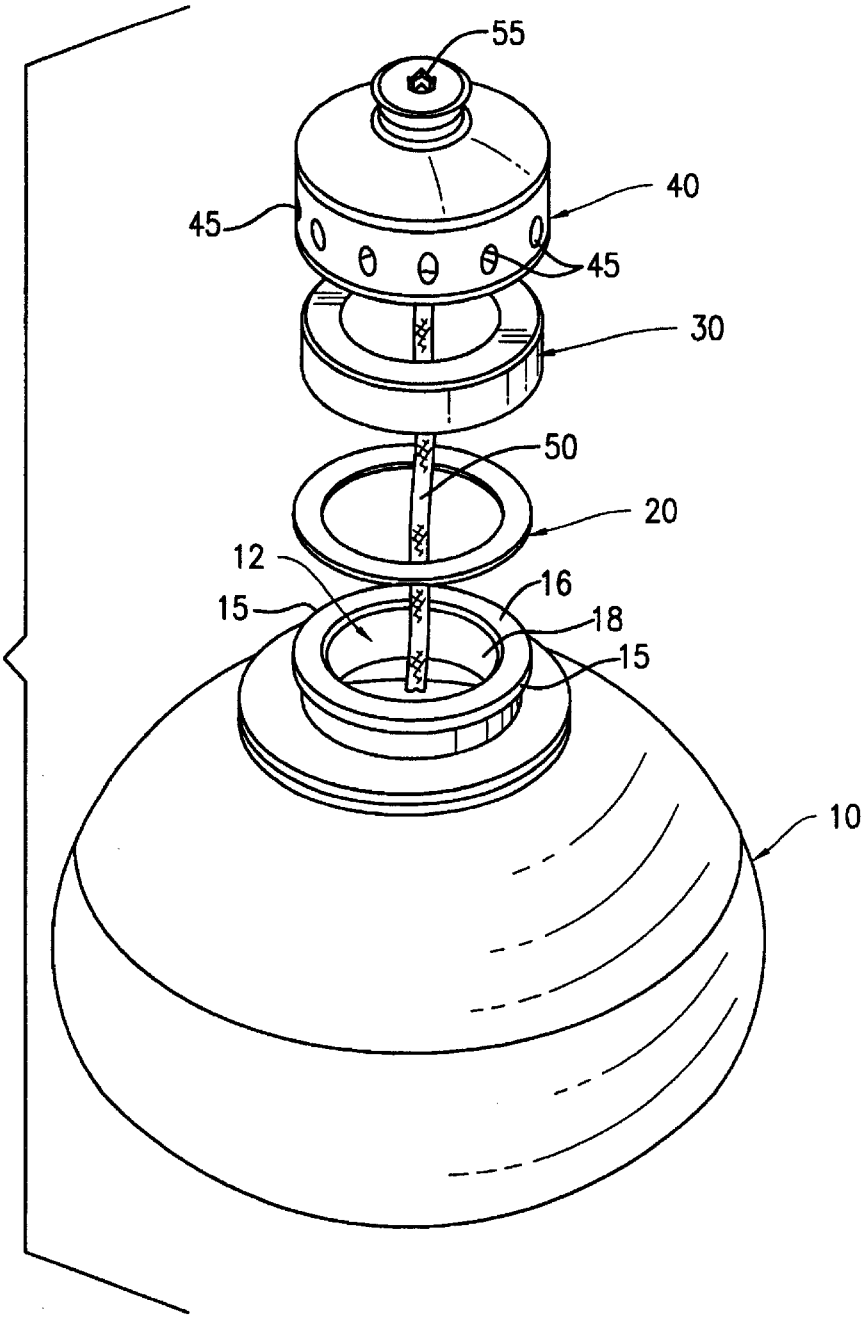
FIG. 3 is an exploded top, front, side perspective view of the components of the oil lamp of FIG. 1.

FIGS. 2 and 3 show the components of the lamp underneath the outer cover 40.

FIG. 2 displays the internal portions of the oil lamp 5, including ceramic diffuser 30, the top opening 12 of container 10 having inner wall 18 and fuel oil and fragrance mixture 100 in the container 10. Fuel oil and fragrance mixture 100 is drawn up fiber wick 50 into contact with ceramic diffuser 30 for diffusing the fragrance into the air. The wick 50 has a top end 60 which extends through wick holder 55 on the outer cover 40. In a preferred embodiment, the wick 50 is doubled over forming a loop at top end 60. Such a construction assists manufacture of the oil lamp 5. The top end 60 receives fuel oil and fragrance mixture 100 and can be lighted to burn fuel oil from the mixture 100.

As best seen in the exploded view of FIG. 3, the outer cover 40 has several vents 45 through the sides. The vents 45 are provided for permitting fragrance drawn through the wick 50—shown as a single strand embodiment in FIG. 3—and absorbed by the ceramic diffuser 30 to be emanated by diffusion into the air surrounding the lamp 5. Different numbers and sizes of vents 45 may be used, provided the structural integrity of the outer covering 40 is maintained.

A sealing gasket 20 is interposed between the lower surface of the ceramic diffuser 30 and the upper surface 16 of top opening lip 15 on container 10. The outer cover 40 fits over the ceramic diffuser 30 and secures it in place on the sealing gasket 20 to provide a seal between the diffuser 30 and container top opening 12. It is intended that the fuel oil and fragrance mixture 100 can only exit the container 10 via the wick 50 or by diffusion through ceramic diffuser 30, as described in greater detail below.

Figure 4:
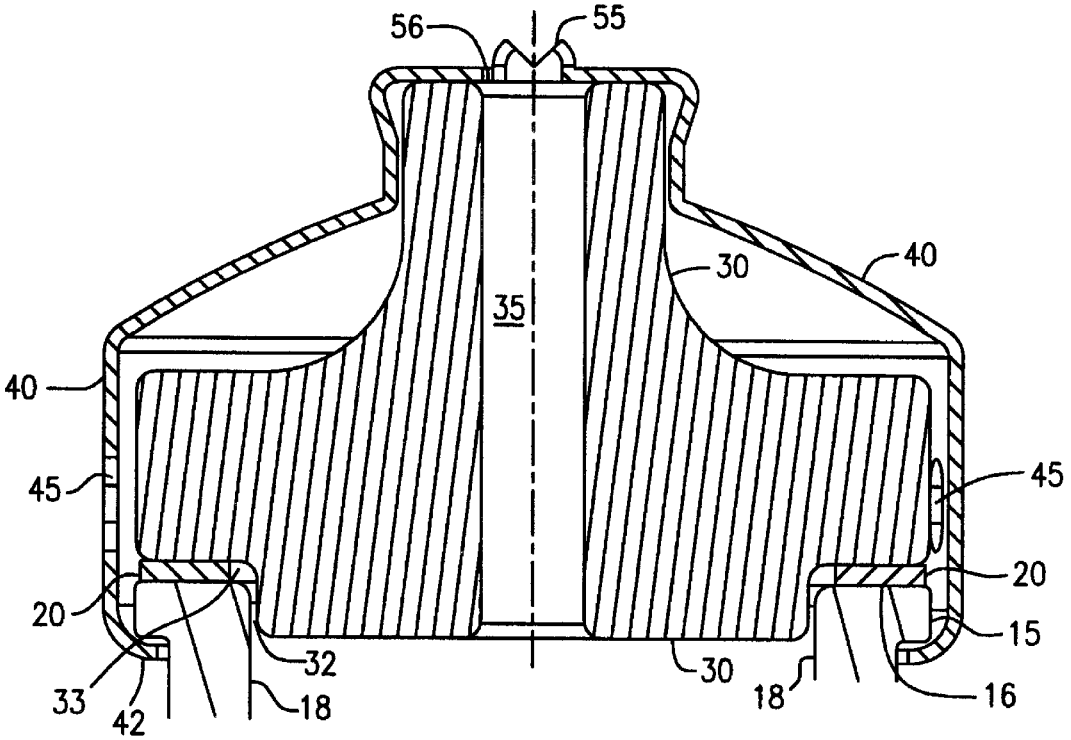
FIG. 4 is an enlarged sectional side elevation of the top portion of the oil lamp of FIG. 2.

FIG. 4 shows the upper portion of the lamp 5 in greater detail, so that the seal provided around the upper surface 16 of the top opening 12 is more clearly seen. The sealing gasket 20 fits between the upper surface 16 and the lower edge of the diffuser 30. The lower edge is formed as a flange surface 33 with an adjacent vertical wall 32. The flange surface 33 contacts the sealing gasket and provides the sealing surface with the upper surface 16. The vertical wall 32 is used to help position the ceramic diffuser 30 over the top opening 12. The vertical wall 32 may contact top opening wall 18 to further improve the seal as well.

The outer cover 40 fits over the ceramic diffuser 30 and has an inwardly turned bottom edge 42 which fits over top opening lip 15. The bottom edge 42 is formed by crimping. Pressure from the top of the outer cover 40 adjacent the wick holder 55 holds the ceramic diffuser 30 against sealing gasket 20 and upper surface 16, forming a substantially leak-proof seal. The seal is intended to prevent large volume spills through the vent holes 45 when the oil lamp 5 is tipped over by accident.

Spills of the mixture 100 are substantially prevented since the wick 50 preferably occupies a majority of the space in wick passage 35 of the ceramic diffuser 30. Small amounts of mixture 100 may escape through gaps between the wick 50 and wick holder 55 opening or air vent 56. The wick 50 occupies substantially the entire wick holder 55 opening in order to be held in position properly. The greater the contact made between the wick 50 and walls of wick passage 35, the greater the amount of fragrance that will be emanated from the ceramic diffuser 30 as well.

Figure 5:
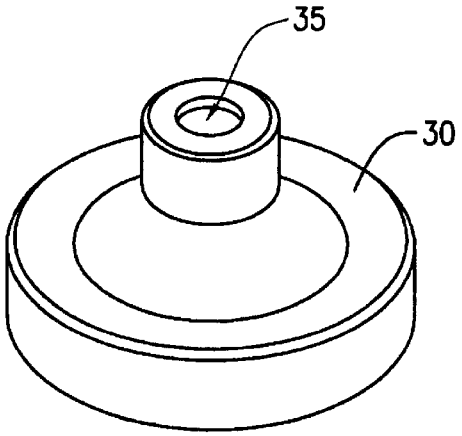
FIG. 5 is a top, front, side perspective view of a diffuser of the invention used in the oil lamp of FIG. 1.

FIG. 5 displays the ceramic diffuser 30 so that the exterior shape can be seen. The shape is preferably similar to the contours of the outer cover 40 so that the maximum surface area and volume for the diffuser 30 are obtained. It should be noted that while the wick passage 35 is shown through the center of the diffuser 30, it may be placed off-center, provided the wick 50 can still be positioned through a wick holder 55 in the outer cover 40. The wick holder 55 may be placed off-center in such case as well. Further, the wick holder 55 and diffuser 30 can be non-circular.

Figure 6:
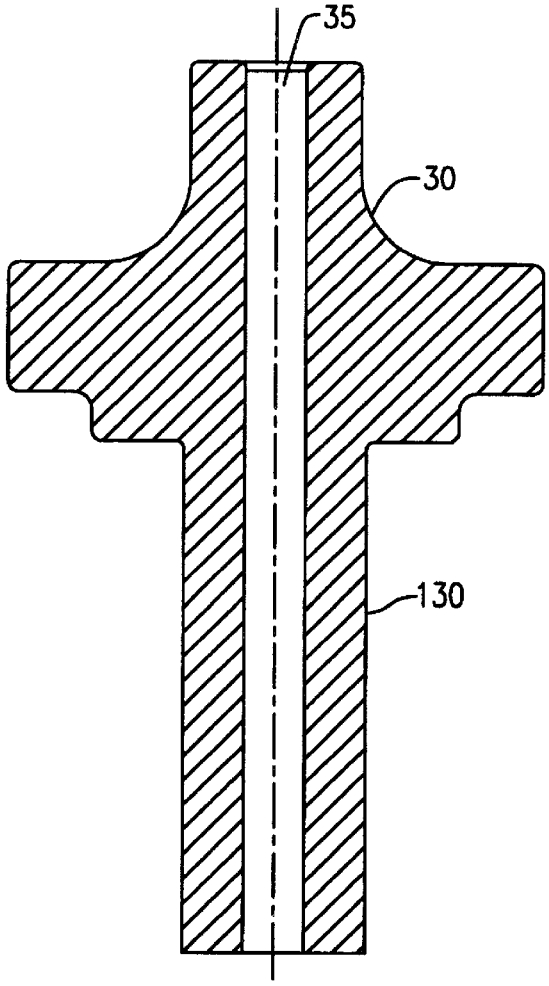
FIG. 6 is a sectional side elevational view of an alternate embodiment of the diffuser according to the invention.

An alternate shape of the ceramic diffuser 30 is shown in FIG. 6 which has an extended portion, or tail 130. The tail 130 is sufficiently long to extend into the fuel oil and fragrance mixture 100, so that oil and fragrance are directly absorbed by the diffuser 30. The wick passage through the diffuser 30 is extended through the tail 130 to provide access for the wick 55 to the mixture 100.

Figure 7:
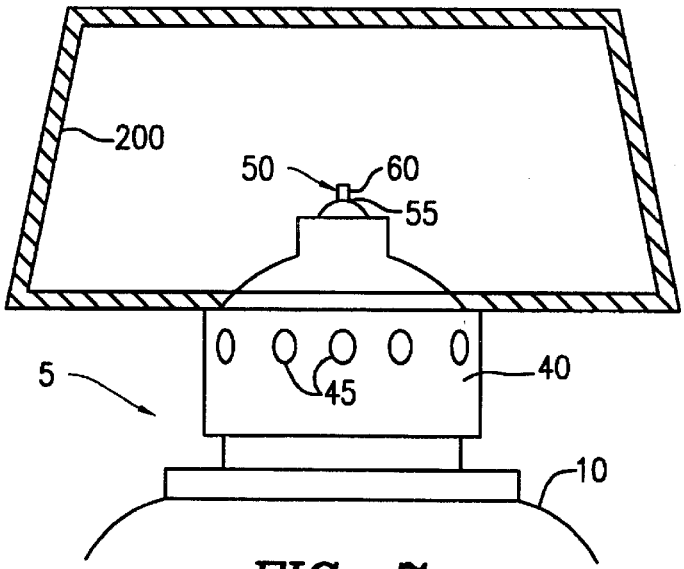
FIG. 7 is a further embodiment of the oil lamp having a lampshade.

In a further embodiment, a non-combustible lampshade 200 may be positioned over the oil lamp 5 and supported on the top edge 48 of the outer cover 40, as shown in FIG. 7.

Preferred materials for the components of the oil lamp 5 include plastics, such as thermoplastics, metal, glass and ceramic for the container 10, although durable plastics are most preferred. PVC is preferred for a clear plastic container. The ceramic diffuser 30 is preferably made of an alumina bisque, but other porous ceramics and materials such as POREX foam and cellulose are acceptable for use as well.

Mercury porosimetry and nitrogen adsorption measurements of alumina bisque pore size and pore volume indicate acceptable diffuser ranges have pore sizes of about 0.5 to 2.0 microns and pore volumes of about 0.15 ml/g to 0.30 ml/g. The optimum size and volume of the reticulated pores depends upon the hydrophobic character of the diffuser and the fragrance/oil mixture. For example, a hydrophobic diffuser and a hydrophobic fragrance/oil mixture can accommodate larger pore size and volume for mass transport through the diffuser. A more hydrophilic diffuser, such as cellulose, requires a smaller pore size and volume to maximize capillary action for mass transport. One skilled in the art will understand that the addition of combustible, oil soluble surface-active materials to the lamp oil can be used to optimize various diffuser and fragrance/oil combinations.

The diffuser can be shaped differently to further increase the diffusion surface area, such as by including fins or other surface texture, provided it does not interfere with the outer cover 40.

The outer cover 40 is preferably made entirely of metal or other non-combustible, heat-conducting materials, since the flame of the lamp is in close proximity to the top of the cover 40. The heat transfer properties of the material used should be selected to heat the ceramic diffuser to enhance evaporation of fragrance or fuel plus fragrant oil from the saturated diffuser body, but also to limit the heat transfer to the diffuser to about 50° F. less than the flashpoint of the fuel and fragrance mixture 100, or less than about 175° F.

The enhanced evaporation of the fragrance causes more liquid mixture 100 from the oil lamp container 10 to be absorbed into the diffuser, to replace the liquid that had evaporated due to the extra heating of the diffuser.

Bendable metals such as tin which are easily crimped over to form the bent lower edge 42 are preferred for use for the outer cover 40. The outer cover 40 may also have a plastic lining of a non-combusting material to improve the seal between the outer cover 40 and diffuser 40.

The fuel oil can be any known type used in oil lamps, but paraffin lamp oil is preferred. The fragrance is preferably present in the mixture in an amount between 3–7% wt. of the total mixture, with about 5% being most preferred. Perfumes and other fragrance oils can be used for the fragrance.

In use, the lamp 5 is lighted, and heat from the flame at the top end 60 of fiber wick 50 heats the metal outer cover 40. Heat is transferred to the ceramic diffuser 30, which has received oil and fragrance mixture 100 from the wick 50 passing through wick passage 35. The heat causes more of the fragrance absorbed by the ceramic diffuser 30 to evaporate and diffuse into the air through the vents 45 in the outer cover 40.

In the event that the lamp 5 is tipped over, the sealing gasket 20 and wick 50 prevent large amounts of oil from leaking out of the lamp 5. At the same time, the ceramic diffuser 30 directly absorbs more of the mixture 100 due to contact from tipping. The ceramic diffuser 30 becomes saturated, but will not drip and provides a seal for the container 10. This permits the oil lamp 5 to be safely shipped in an assembled state.

The lamp 5 of the invention improves over prior disposable lamps which have separate fragranced emanators since the oil and fragrance are used up at the same rate. Further, when preferred materials are used, testing has shown that the lamp 5 of the invention can provide a fragrance to an area having substantially the same effect as commercially available 3"×3" pillar-type candles.

The oil lamp 5 provides a self-contained, spill proof lamp which can be manufactured in many different fragrances simply by changing the fragrance added to the oil mixture, rather than having to substitute different emanators or scent packets or supplies.

While a specific embodiment of the invention has been shown and described in detail to illustrate the application of the principles of the invention, it will be understood that the invention may be embodied otherwise without departing from such principles.

What is claimed is:

1. A fragrance-emitting oil lamp, comprising;

a container having a top opening and holding a mixture of fuel oil and a perfume;

a diffuser mounted on the container over the top opening, the diffuser having a wick passage therethrough;

a sealing gasket intersposed between the top opening and the diffuser;

an outer cover secured over the diffuser and top opening creating a seal between the diffuser, gasket and top opening, and having a wick holding opening;

diffusion means in the outer cover for permitting perfume to emanate from the diffuser into air outside the center cover; and a wick sized to be held within the wick holding opening with a top end of the wick above the wick holding opening and the wick passed through and at least partly in contact with sides of the wick passage for drawing fuel oil and perfume into contact with the diffuser, at least some perfume from the wick passing through the diffuser to the air outside, and to the top end for burning when the wick is lighted.

2. An oil lamp according to claim 1, wherein the top opening has a horizontal lip and the outer cover has a lower edge crimped or bent over the horizontal lip.

3. An oil lamp according to claim 1, wherein the diffuser is made of one of a porous ceramic, a porous foam, and a porous cellulose.

4. An oil lamp according to claim 3, wherein the diffuser is made of a porous ceramic.

5. An oil lamp according to claim 4, wherein the porous ceramic is an alumina bisque.

6. An oil lamp according to claim 4, wherein the mixture comprises from 93–97% wt. of fuel oil and 3–7% wt. of a fragrance, based on the total weight of the mixture.

7. An oil lamp according to claim 6, wherein the fragrance comprises about 5% wt. of the total weight of the mixture.

8. An oil lamp according to claim 7, wherein the diffuser has a tail.

9. An oil lamp according to claim 7, wherein the diffusion means comprises at least two vents through the side of the outer cover.

10. An oil lamp according to claim 1, wherein the container is made of one of plastic, glass, ceramic and metal.

11. An oil lamp according to claim 1, wherein the mixture comprises from 93–7% wt. of fuel oil and 3–7% wt. of a fragrance, based on the total weight of the mixture.

12. An oil lamp according to claim 11, wherein the fragrance comprises about 5% wt. of the total weight of the mixture.

13. An oil lamp according to claim 1, wherein the diffuser has a tail.

14. An oil lamp according to claim 13, wherein the diffuser is made of one of a porous ceramic, a porous foam, and a porous cellulose.

15. An oil lamp according to claim 14, wherein the container is made of one of plastic, glass, metal and ceramic.

16. An oil lamp according to claim 1, further comprising a lampshade attached to an upper surface of the outer cover.

17. An oil lamp according to claim 1, wherein the container is made of a clear PVC plastic.

18. An oil lamp according to claim 1, wherein the outer cover is made of non-combustible, heat-conducting material so that heat from a flame burning at the wick when the wick is lighted, is transferred to the diffuser to enhance evaporation of the mixture from the diffuser.

19. An oil lamp according to claim 18, wherein the outer cover is made of metal.

* * * * *